US009704449B2

(12) United States Patent
Kim et al.

(10) Patent No.: US 9,704,449 B2
(45) Date of Patent: Jul. 11, 2017

(54) GATE DRIVING CIRCUIT AND DISPLAY DEVICE INCLUDING THE SAME

(71) Applicant: Samsung Display Co., Ltd., Yongin-si (KR)

(72) Inventors: Se-Hyang Kim, Yongin-si (KR); Kyung-Hoon Kim, Uiwang-si (KR); KyoungHo Lim, Suwon-si (KR); Kwang-chul Jung, Seongnam-si (KR); Junki Jeong, Anyang-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 152 days.

(21) Appl. No.: 14/836,200

(22) Filed: Aug. 26, 2015

(65) Prior Publication Data

US 2016/0210918 A1 Jul. 21, 2016

(30) Foreign Application Priority Data

Jan. 21, 2015 (KR) ..... 10-2015-0010203

(51) Int. Cl.
*G09G 5/00* (2006.01)
*G09G 3/36* (2006.01)

(52) U.S. Cl.
CPC ... *G09G 3/3677* (2013.01); *G09G 2300/0408* (2013.01); *G09G 2310/0281* (2013.01)

(58) Field of Classification Search
CPC ..... G09G 3/3677; G09G 2310/0281; G09G 2300/0408
USPC ..... 345/204
See application file for complete search history.

(56) References Cited

U.S. PATENT DOCUMENTS

| | | | | |
|---|---|---|---|---|
| 6,496,238 | B1 | 12/2002 | Greene et al. | |
| 6,654,449 | B1 | 11/2003 | Greene et al. | |
| 6,667,783 | B2 | 12/2003 | Greene et al. | |
| 8,400,390 | B2 | 3/2013 | Lee et al. | |
| 9,024,858 | B2 | 5/2015 | Koo et al. | |
| 2008/0074379 | A1 | 3/2008 | Kim et al. | |
| 2010/0156869 | A1* | 6/2010 | Lee | G09G 3/3677 345/208 |
| 2011/0069044 | A1* | 3/2011 | Lee | G11C 19/28 345/204 |

(Continued)

FOREIGN PATENT DOCUMENTS

| | | |
|---|---|---|
| KR | 10-2010-0075019 | 7/2010 |
| KR | 10-2013-0045570 | 5/2013 |

(Continued)

*Primary Examiner* — Jonathan Boyd
(74) *Attorney, Agent, or Firm* — H.C. Park & Associates, PLC

(57) ABSTRACT

The gate driving circuit includes an (m−1)-th stage externally receiving a first dummy signal for a first time period to control a turn-off, an m-th stage externally receiving a second dummy signal for the first time period to control the turn-off, an (m−2)-th stage receiving an m-th carry signal for a second time period from the m-th stage and externally receiving the second dummy signal for the second time period to control the turn-off, and an (m−3)-th stage receiving an (m−1)-th carry signal for the second time period from the (m−1)-th stage and externally receiving the first dummy signal for the first time period to control the turn-off, wherein the first time period is longer than the second time period.

16 Claims, 6 Drawing Sheets

(56) References Cited

U.S. PATENT DOCUMENTS

| | | | | |
|---|---|---|---|---|
| 2011/0157263 | A1* | 6/2011 | Kim | G09G 3/3677 345/698 |
| 2013/0249872 | A1* | 9/2013 | Kang | G09G 3/3677 345/204 |
| 2013/0335392 | A1 | 12/2013 | Cho et al. | |

FOREIGN PATENT DOCUMENTS

| | | |
|---|---|---|
| KR | 10-1298094 | 8/2013 |
| KR | 10-2013-0142454 | 12/2013 |

* cited by examiner

GATE DRIVING CIRCUIT AND DISPLAY DEVICE INCLUDING THE SAME

CROSS-REFERENCE TO RELATED APPLICATION

This application claims priority from and the benefit of Korean Patent Application No. 10-2015-0010203, filed on Jan. 21, 2015, which is hereby incorporated by reference for all purposes as if fully set forth herein.

BACKGROUND

Field

Exemplary embodiments relate to a gate driving circuit and a display device including the same, and more particularly, to a gate driving circuit not including a dummy driver and a display device including the same.

Discussion of the Background

A display device includes a display panel and a driving unit for driving the display panel. The display panel includes a display area displaying an image and a non-display area surrounding the display area. The display area includes gate lines extended in a first direction and data lines extended in a second direction perpendicular to the first direction.

The driving unit includes a timing controller, a gate driving circuit, and a data driver. The gate driving circuit is disposed in the non-display area located outside the display area in the first direction and connected to the gate lines. The data driver is mounted on a chip on film (COF) package or a printed circuit board, and the COF package or printed circuit board is connected to the non-display area located outside the display area in the second direction.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a display device in which a bezel width is reduced in one direction.

Additional aspects will be set forth in the detailed description which follows, and, in part, will be apparent from the disclosure, or may be learned by practice of the inventive concept.

An exemplary embodiment discloses a gate driving circuit including m stages (where m is an integer of 4 or greater), each of which outputs a gate signal and is sequentially connected in a cascade arrangement, the gate driving circuit including: an (m−1)-th stage externally receiving a first dummy signal for a first time period to control a turn-off; an m-th stage externally receiving a second dummy signal for the first time period to control the turn-off; an (m−2)-th stage receiving an m-th carry signal for a second time period from the m-th stage and externally receiving the second dummy signal for the second time period to control the turn-off; and an (m−3)-th stage receiving an (m−1)-th carry signal for the second time period from the (m−1)-th stage and externally receiving the first dummy signal for the first time period to control the turn-off, wherein the first time period is longer than the second time period.

An exemplary embodiment also discloses a display device including a thin film transistor substrate including a display area comprising gate lines extended in a first direction and a plurality of data lines insulated from the plurality of gate lines and extended in a second direction intersecting with the first direction, and a non-display area peripheral to the display area. A gate driving circuit is disposed in the non-display area and includes a gate driving circuit including m stages (where m is an integer of 4 or greater) for providing a gate signal to the gate lines, wherein the gate driving circuit includes an (m−1)-th stage externally receiving a first dummy signal during a first time period to control a turn-off; an m-th stage externally receiving a second dummy signal during the first time period to control the turn-off; an (m−2)-th stage receiving an m-th carry signal for a second time period from the m-th stage and externally receiving the second dummy signal for the second time period to control the turn-off; and an (m−3)-th stage receiving an (m−1)-th carry signal for the second time period from an (m−1)-th stage and externally receiving the first dummy signal for the first time period to control the turn-off, wherein the first time period is longer than the second time period.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
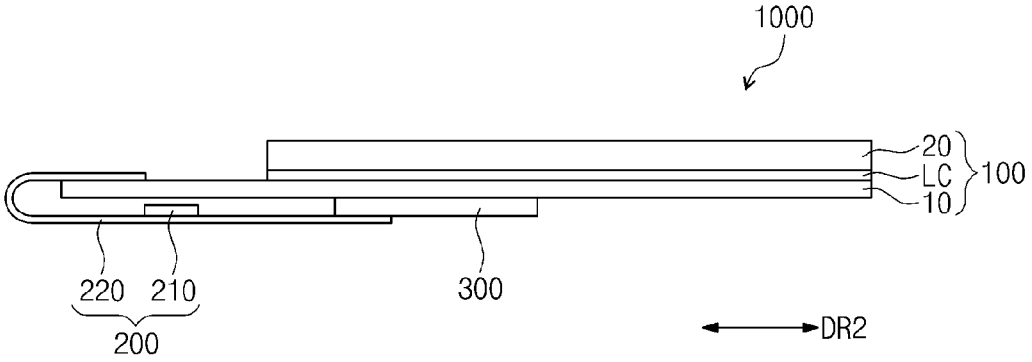
FIG. 1 is a cross-sectional view of a display device according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. As such, the regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Figure 2:
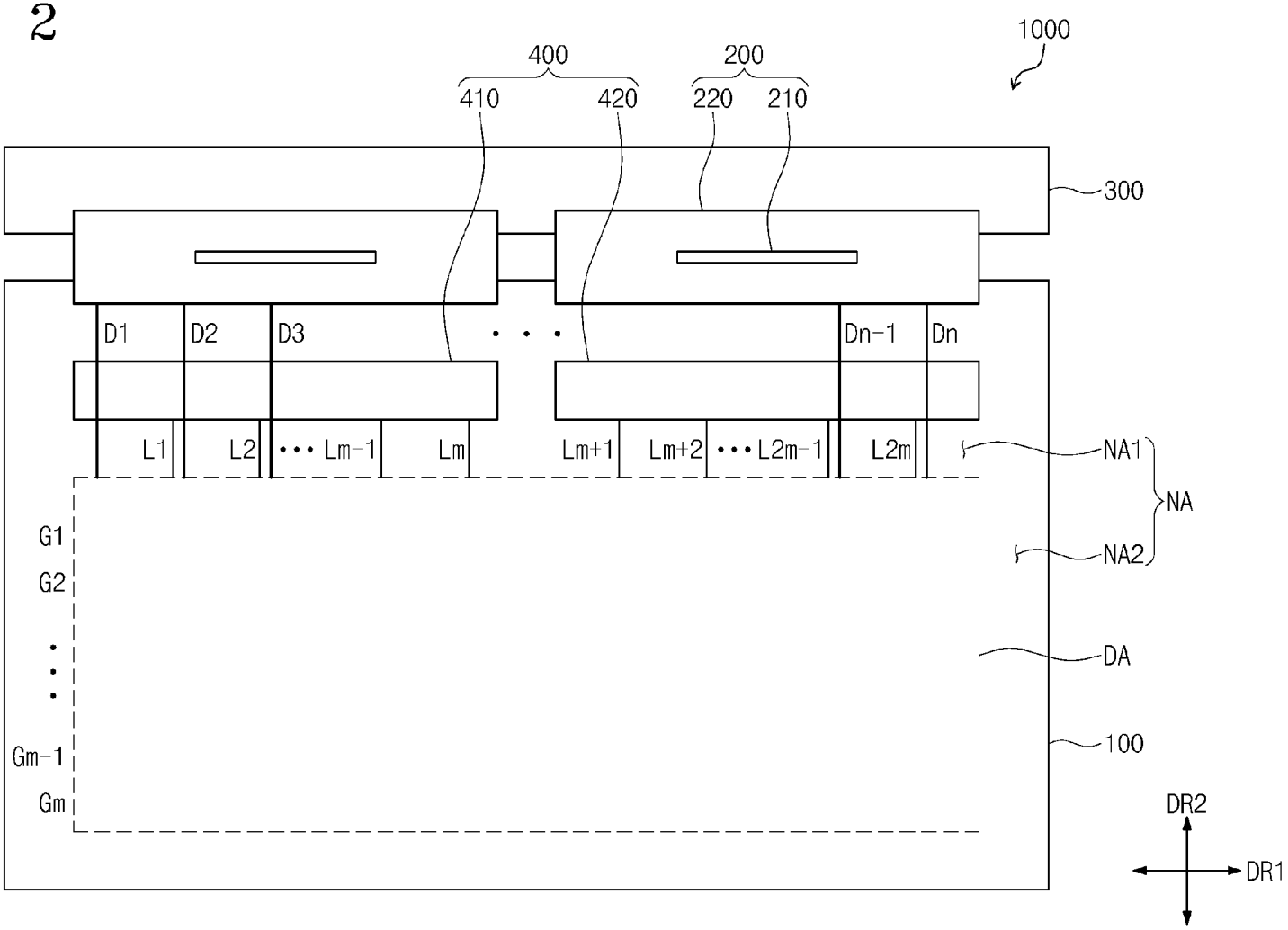
FIG. 2 is a plan view illustrating the display device of FIG. 1.
Figure 3:
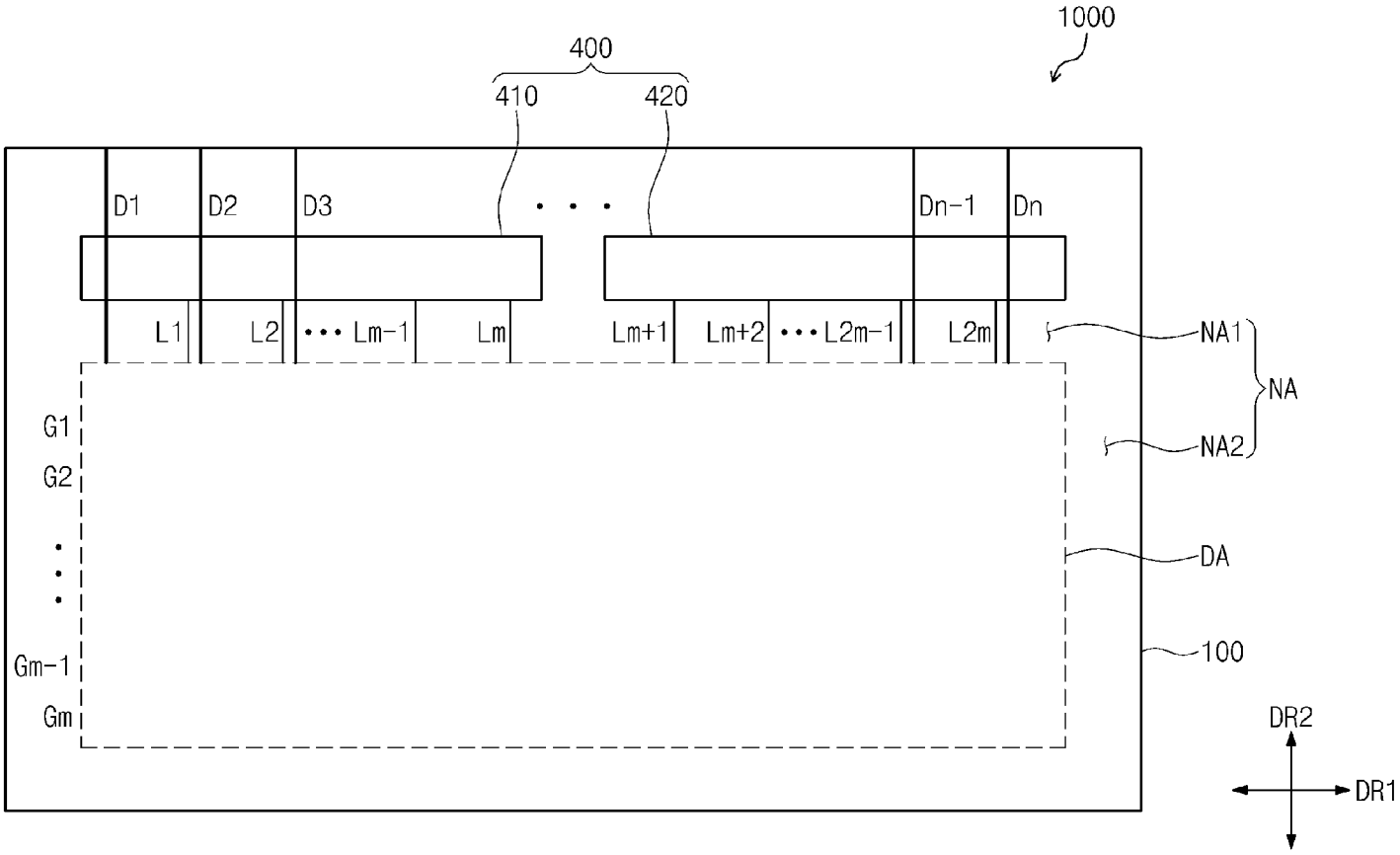
FIG. 3 is a plan view illustrating the display panel of FIG. 2.

FIG. 1 is a cross-sectional view of a display device 1000 according to an exemplary embodiment, FIG. 2 is a plan view illustrating the display device 1000 of FIG. 1, and FIG. 3 is a plan view illustrating the display panel of FIG. 2. Referring to FIGS. 1 to 3, the display device 1000 may include a display panel 100, a printed circuit board (PCB) 200, and a flexible PCB 300.

The display panel 100 displays an image. The display panel 100 may include various display panels such as an organic light emitting display panel, a liquid crystal display panel, a plasma display panel, an electrophoresis display panel, and an electrowetting display panel, and the description hereinafter will be provided with a liquid crystal display panel exemplified as the display panel 100.

The display panel 100 includes a thin film transistor (TFT) substrate 10, a counter substrate 20, and a liquid crystal layer LC disposed therebetween.

The TFT substrate 10 includes a display area DA and a non-display area NA surrounding the display area DA. The display area DA is an area on which an image is displayed, and a non-display area is an area on which an image is not displayed by being covered with a black matrix or the like.

The display area DA includes a plurality of data lines D1 to Dn, a plurality of gate lines G1 to Gm, and a plurality of pixels PX disposed in a matrix formed by the plurality of gate lines G1 to Gm and the plurality of data lines D1 to Dn. The gate lines G1 to Gm are extended in a first direction DR1 and separated from each other in a second direction DR2 perpendicular to the first direction DR1. The data lines D1 to Dn are extended in the second direction DR2 and separated from each other in the first direction DR1.

The non-display area NA may include a first non-display area NA1 and a second non-display area NA2. The first non-display area NA1 is peripheral area of the display area DA in the second direction DR2. Based on FIGS. 2 and 3, the first non-display area NA1 includes upper and lower areas adjacent the display area DA. The second non-display area NA2 is a peripheral area of the display area DA in the first direction DR1. Based on FIGS. 2 and 3, the second non-display area NA2 includes right and left areas adjacent the display area DA.

The counter substrate 20 is disposed opposite to the TFT substrate 10. The counter substrate 20 may include a color filter providing a color to an image and the black matrix overlapping the non-display area NA.

The liquid crystal layer LC includes a plurality of liquid crystal molecules having a dielectric anisotropy. The liquid crystal molecules of the liquid crystal layer LC rotate in a specific direction according to an electric field formed in the liquid crystal layer LC and adjust transmittance of light incident to the liquid crystal layer LC.

The flexible PCB 200 electrically connects the display panel 100 and the PCB 300. The flexible PCB 200 includes a base film 220 and an integrated circuit chip 210 formed on the base film 220.

FIGS. 1 and 2 disclose an exemplary embodiment wherein the flexible PCB 200 is provided in two parts separated from each other in the first direction DR1. However, the flexible PCB 200 may also be provided in only one part or more than two parts without departing from the inventive concept.

The flexible PCB 200 may be mounted on the display panel 100 in a "C"-shaped curved state. The flexible PCB 200 may extend along a side surface on the top surface of the TFT substrate 10 and be fixed on the bottom surface of the TFT substrate 10. To this end, the flexible substrate 200 is flexible.

The PCB 300 plays a role in driving the display panel 100. The PCB 300 may include a driving substrate (not illustrated) and a plurality of circuit components (not illustrated) mounted on the driving substrate (not illustrated). The PCB 300 may be mounted on the bottom surface of the TFT substrate 10 with the flexible PCB 200 curved and mounted thereon.

The display device 1000 may further include a timing controller (not illustrated), a gate driving circuit 400, and a data driver (not illustrated).

The timing controller may be mounted on either the flexible PCB 200 or the PCB 300. The timing controller receives a control signal to generate a gate control signal and a data control signal. The timing controller outputs the gate control signal to the gate driving circuit 400 and the data control signal to the data driver. The timing controller may receive an image signal and output the image signal to the data driver.

The gate control signal may include a vertical start signal for starting operation of the gate driving circuit 400 and a gate clock signal determining an output time of the gate signal.

The data control signal may include a horizontal start signal for starting operation of the data driver, a polarity inversion signal for controlling the polarity of a data voltage output from the data driver, and a load signal for determining a time when the data voltage is output.

The gate driving circuit 400 may be mounted on the TFT substrate 10. In detail, the gate driving circuit 400 may be disposed to overlap the first non-display area NA1. FIGS. 2 and 3 illustrates an exemplary gate driving circuit 400 overlapping the first non-display area NA1 between the display area DA and the flexible PCB 200.

The gate driving circuit 400 may generate the gate signal based on the gate control signal. The gate driving circuit 400 is electrically connected to the gate lines G1 to Gm and sequentially outputs the gate signal to the gate lines G1 to Gm.

The display panel 100 may further include connection lines L1 to L2*m* connecting the gate driving circuit 400 and the gate lines G1 to Gm to each other. The connection lines L1 to L2*m* are extended in the second direction DR2 and separated from the data lines D1 to Dn.

The gate driving circuit 400 may include the first and second driving circuits 410 and 420 separated from each other.

Each of the first and second gate driving circuit 410 and 420 may be connected to the gate lines G1 to Gm.

The connection lines L1 to L2*m* may include first connection lines L1 to Lm and second connection lines Lm+1 to L2*m*. The first connection lines L1 to Lm connect the first gate driving circuit 410 to the gate lines G1 to Gm, and the second connection lines Lm1 to L2*m* connect the second gate driving circuit 420 to the gate lines G1 to Gm. The number of the first connection lines L1 to Lm may be the same as that of the gate lines G1 to Gm. The first connection lines L1 to Lm may be respectively connected to the gate lines G1 to Gm, and the second connection lines Lm+1 to L2*m* may be respectively connected to the gate lines G1 to Gm.

The first connection lines L1 to Lm may have different lengths from each other and the second connection lines Lm+1 to L2*m* may have different lengths from each other. FIGS. 2 and 3 disclose that the lengths of the first and second connection lines L1 to Lm and Lm+1 to L2*m* may be sequentially increased.

The first connection lines L1 to Lm may have respectively shorter lengths than the second connection lines Lm+1 to L2*m*. As an example, the first connection lines L1 to Lm may be connected to the gate lines G1 to Gm from the first gate driving circuit 410 in the second direction DR2 via the shortest routes. In addition, the second connection lines Lm+1 to L2*m* are extended in the second direction DR2 to pass through the display area DA, and curved at the first non-display NA1 outside an m-th gate line Gm to be connected to the gate lines G1 to Gm.

One gate line may be connected to a first main connection line and a second connection line. In detail, a first gate line G1 may be connected to a first line L1 of the first connection lines and a 2*m*-th line L2*m* of the second connection lines. Similarly, the m-th gate line Gm may be connected to an m-th line Lm of the first connection lines and an (m+1)-th line Lm+1 of the second connection lines.

Typically, the gate driving circuit includes a plurality of stages respectively connected to the gate lines GL1 to GLm and at least one dummy stage for applying a carry signal to a part of the plurality of stages. However, referring to FIGS. 1 to 3, the data driver (not illustrated) and the first and second gate driving circuits 410 and 420 are disposed in the first direction DR1. Therefore, there is no space in which the dummy stage is disposed between the first and second gate driving circuits 410 and 420. Accordingly, instead of using the dummy stage for applying the carry signal, the carry signal is applied externally.

Figure 4:
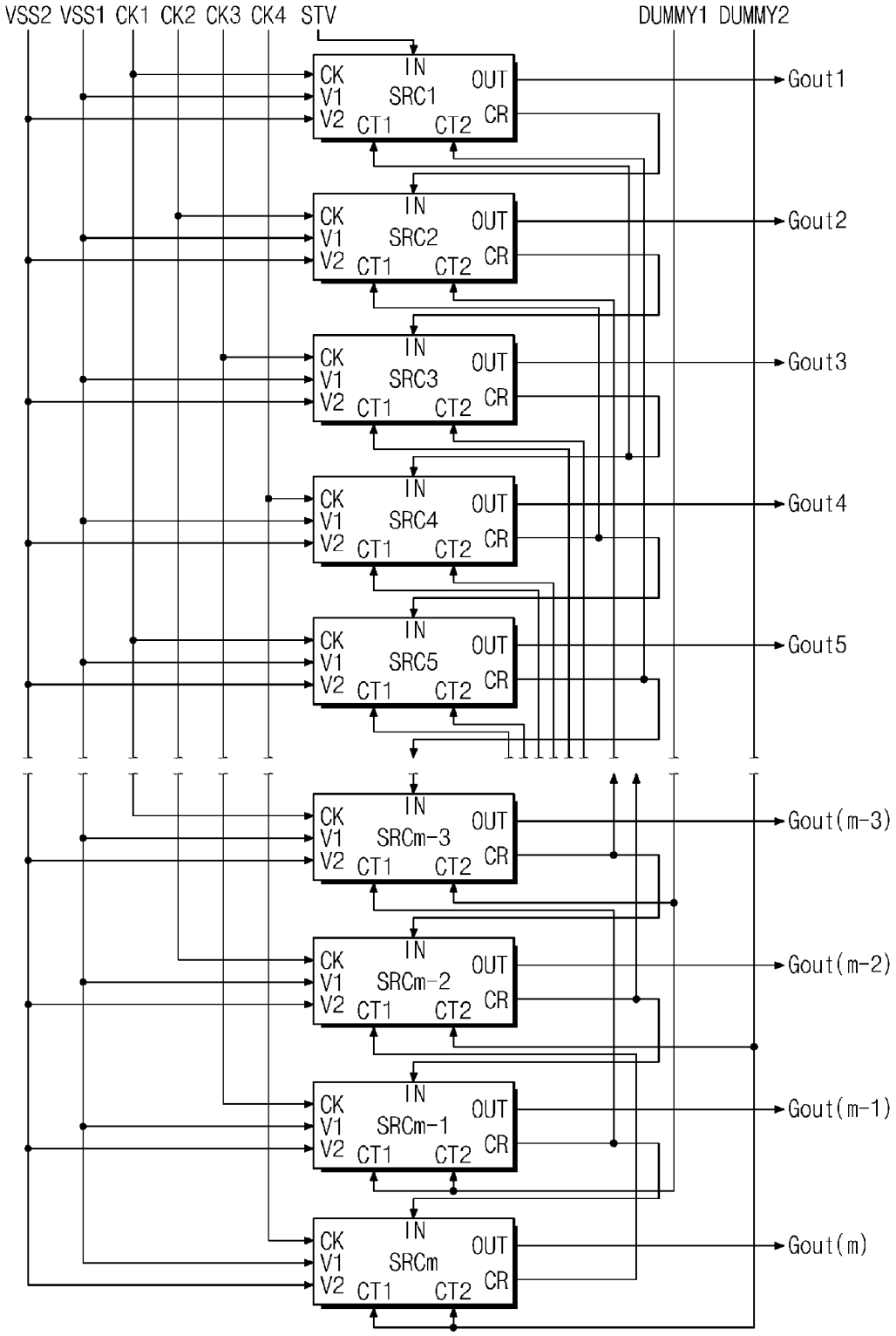
FIG. 4 is a block diagram illustrating the gate driving circuit of FIGS. 1 and 2.

FIG. 4 is a block diagram illustrating the gate driving circuit of FIGS. 1 and 2. It is assumed that the stages STR1 to STRm illustrated in FIG. 4 are included in the first gate driving circuit 410. In addition, the first and second gate driving circuits 410 and 420 may include the same configuration. Accordingly, the first and second gate driving circuits 410 and 420 may be driven in the same method.

The plurality of stages SRC1 to SRCm are respectively connected to the gate lines G1 to Gm in one-to-one correspondence. In other words, the plurality of stages SRC1 to SRCm may respectively provide gate signals Gout1 to Gout(m) to the plurality of gate lines G1 to Gm.

Each of the plurality of stages SRC1 to SRCm includes an input terminal IN, a clock terminal CK, first and second voltage input terminals V1 and V2, first and second control terminals CT1 and CT2, an output terminal OUT, and a carry terminal CR.

The input terminal IN of each of the plurality of stages SRC1 to SRCm is electrically connected to the carry terminal CR of a preceding stage and receives a carry signal of the preceding stage. For example, the input terminal IN of the ith stage (not illustrated) is electrically connected to the carry terminal CR of (i−1)-th stage. Here, i is an integer greater than 1 and smaller than n.

However, the input terminal IN of the first stage SRC1 of the plurality of stages SRC1 to SRCm receives a start signal STV for starting to drive the gate driving circuits 410 and 420 instead of the carry signal of a preceding stage.

Any one clock signal among first to fourth clock signals CK1 to CK4 is input to the clock terminal CK of each of the plurality of stages SRC1 to SRCm. In detail, the first stage SRC1 receives the first clock signal CK1 and the second stage SRC2 receives the second clock signal CK2. The third stage SRC3 receives the third clock signal CK3 and the fourth stage SRC4 receives the fourth clock signal CK4. In this order, the fifth to m-th stages SRC5 to SRCm respectively and sequentially receive the first to fourth clock signals CK1 to CK4. The first to fourth clock signals CK1 to CK4 are used as a gate voltage of each of the stages SRC1 to SRCm.

A first voltage VSS1 (or a first low voltage) is applied to the first voltage input terminal V1 of each of the plurality of stages SRC1 to SRCm and a second voltage VSS2 (or a second low voltage) is applied to the second voltage input terminal V2 of each of the plurality of stages SRC1 to SRCm. The second voltage VSS2 may have a lower voltage level than the first voltage VSS1. The first and second voltages VSS1 and VSS2 may be a ground voltage or a negative voltage.

The first control terminal CT1 of each of odd numbered stages SRC1 to SRCm−1 of the plurality of stages SRC1 to SRCm is electrically connected to the carry terminal CR of the next odd numbered stage and receives a carry signal from the next odd numbered stage. In addition, the second control terminal CT2 of each of the odd numbered stages SRC1 to SRCm−1 is electrically connected to a carry terminal CR of one following the next odd numbered stage and receives a carry signal from the one following the next odd numbered stage.

For example, the first control terminal CT1 of the first stage SRC1 is electrically connected to the carry terminal CR of the third stage SRC3 and receives a third carry signal. In addition, the second control terminal CT2 of the first stage SRC1 is electrically connected to the carry terminal CR of the fifth stage SRC5 and receives a fifth carry signal.

The first control terminal CT1 of each of even numbered stages SRC2 to SRCm of the plurality of stages SRC1 to SRCm is electrically connected to the carry terminal CR of the next even numbered stage and receives a carry signal from the next even numbered stage. In addition, the second control terminal CT2 of each of even numbered stages SRC2 to SRCm is electrically connected to the carry terminal CR of one following the next even numbered stage and receives a carry signal from the one following the next even numbered stage.

For example, the first control terminal CT1 of the second stage SRC2 is electrically connected to the carry terminal CR of the fourth stage SRC4 and receives a fourth carry signal. In addition, the second control terminal CT2 of the second stage SRC2 is electrically connected to the carry terminal CR of the sixth stage SRC6 and receives a sixth carry signal.

In an exemplary embodiment, dummy stages do not exist for applying carry signals to the second control terminals CT2 of the (m−3)-th and (m−2)-th stages SRCm−3 and SRCm−2 and the first and second control terminals CT1 and CT2 of the (m−1)-th terminal and m-th stages SRCm−1 and SRCm. Therefore, in the exemplary embodiment, dummy signals DUMMY 1 and DUMMY 2 are applied externally to the (m−3)-th to m-th stages SRC(m−3) to SRCm.

The first control terminal CT1 of the (m−3)-th stage SRCm−3 is electrically connected to the carry terminal CR of the (m−1)-th stage SRCm−1 and receives a carry signal from the (m−1)-th stage SRCm. However, since the gate driving circuits 410 and 420 according to an exemplary embodiment do not include the dummy stage, there is not a stage applying a carry signal to the second control terminal CT2 of the (m−3)-th stage SRm−3. Accordingly, the first dummy signal DUMMY1 is applied externally to the second control terminal CT2 of the (m−3)-th stage SRm−3.

The first control terminal CT1 of the (m−2)-th stage SRCm−2 is electrically connected to the carry terminal CR of the m-th stage SRCm and receives a carry signal from the m-th stage SRCm. Accordingly, the second dummy signal DUMMY2 is applied externally to the second control terminal CT2 of the (m−2)-th stage SRm−2.

The first dummy signal DUMMY1 is applied externally to the first and second control terminals CT1 and CT2 of the (m−1)-th stage SRCm−1.

The second dummy signal DUMMY2 is applied externally to the first and second control terminals CT1 and CT2 of the m-th stage SRCm.

The carry signal and the first and second dummy signals DUMMY1 and DUMMY2 are applied to turn off the plurality of stages SRC1 to SRCm. For applying a turn-off signal to the plurality of stages SRC1 to SRCm, two carry signals are applied to each of the plurality of stages SRC1 to SRCm. The first dummy signal DUMMY is applied as a carry signal to the first and second control terminals CT1 and CT2 of the (m−1)-th stage SRCm−1, and the second dummy signal DUMMY2 is applied as a carry signal to the first and second control terminals CT1 and CT2 of the m-th stage SRCm. In this way, since they are simultaneously applied to the first and second control terminals CT1 and CT2, each of the first and second dummy signals DUMMY1 and DUMMY2 is applied for a longer time period than the carry signal. For example, the first and second dummy signals DUMMY1 and DUMMY2 may be applied for twice as long as the carry signal.

The first and second dummy signals DUMMY1 and DUMMY2 are signals applied from outside of the gate driving circuits 410 and 420. In an exemplary embodiment, the first and second dummy signals DUMMY1 and DUMMY2 may be output from the integrated circuit chip 210.

Figure 5:
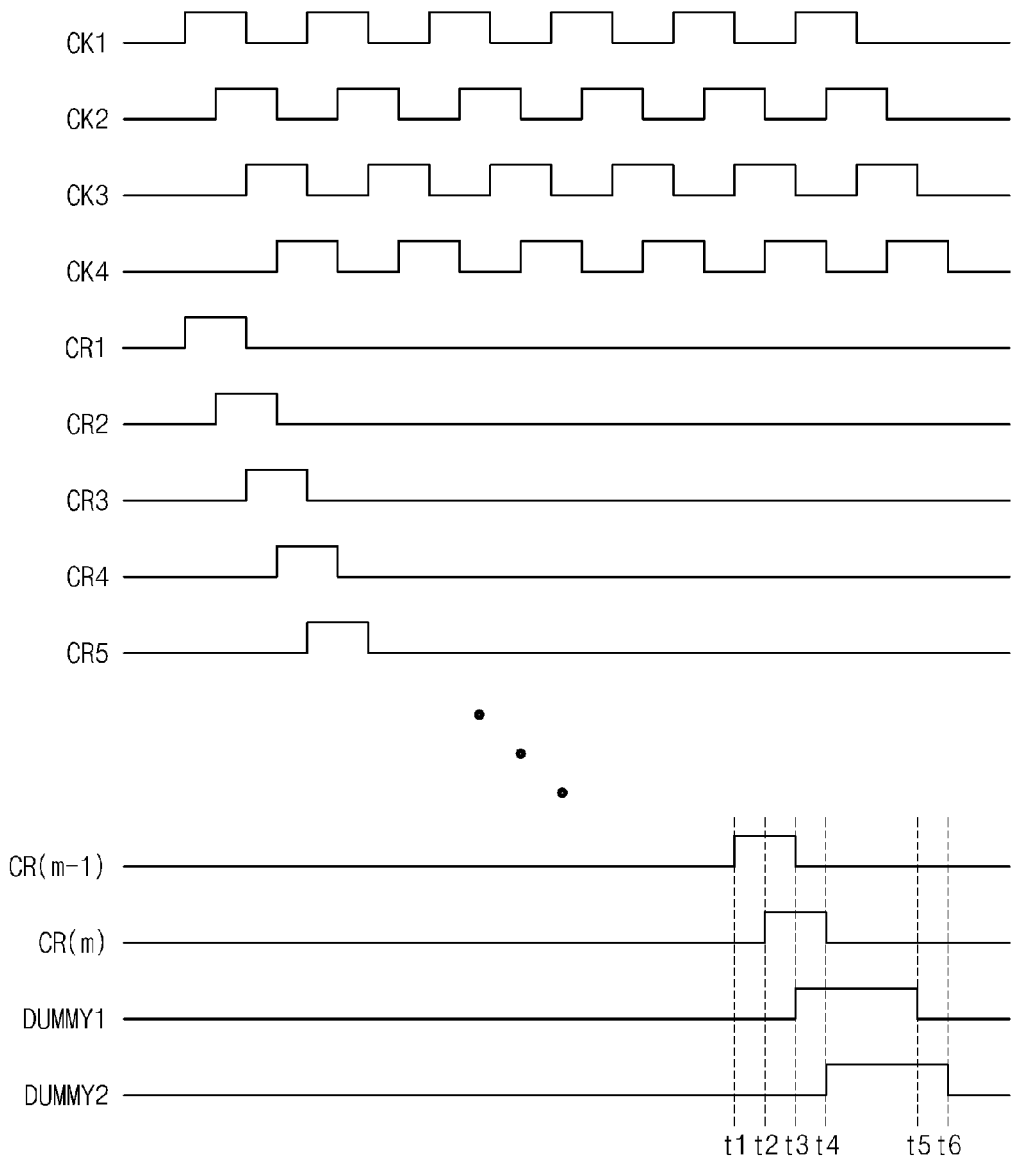
FIG. 5 is a timing diagram for signals applied to the gate driving circuit of FIG. 3.

FIG. 5 is a timing diagram for signals applied to the gate driving circuit of FIG. 4. Referring to FIG. 5, the first to fourth clock signals CK1 to CK4 are sequentially applied to each of clock terminals CK of the plurality of stages SRC1 to SRCm. For example, when the first clock signal CK1 applied to the clock terminal CK of the first stage SRC1 is transitioned to a high state, the first carry signal CR1 output from the carry terminal CR of the first stage SRC1 is transitioned to a high state. When the first clock signal CK1 is transitioned to a low state, the first carry signal CR1 output from the first stage SRC1 is transitioned to a low state.

When the first carry signal CR1 is transitioned to the low state, the third carry signal CR3 output from the third stage SRC3 is applied to the first control terminal CT1 in order to turn-off the first stage SRC1. In addition, in order to turn off the first stage SRC1, when the third carry signal CR3 is transitioned to a low state, the fifth carry signal SRC5 output from the fifth stage SRC5 is applied to the second control terminal CT2.

When the second clock signal CK2 applied to the clock terminal CK of the second stage SRC2 is transitioned to a high state, the second carry signal CR2 output from the carry terminal CR of the second stage SRC2 is transitioned to a high state. When the second clock signal CK2 is transitioned to a low state, the second carry signal CR2 is transitioned to a low state.

When the second carry signal CR2 is transitioned to the low state, the fourth carry signal CR4 output from the fourth stage SRC4 is applied to the first control terminal CT1 in order to turn off the second stage SRC2. In addition, in order to turn off the second stage SRC2, when the fourth carry signal CR4 is transitioned to a low state, the sixth carry signal SRC6 output from the sixth stage SRC6 (not illustrated) is applied to the second control terminal CT2.

When the third clock signal CK3 applied to the clock terminal CK of the third stage SRC3 is transitioned to a high state, the third carry signal CR3 output from the carry terminal CR of the third stage SRC3 is transitioned to a high state. When the third clock signal CK3 is transitioned to a low state, the third carry signal CR3 is transitioned to a low state.

When the third carry signal CR3 is transitioned to the low state, the fifth carry signal CR5 output from the fifth stage SRC5 is applied to the first control terminal CT1 in order to turn off the third stage SRC3. In addition, when the fifth carry signal CR5 is transitioned to a low state, the seventh carry signal SRC7 output from the seventh stage SRC7 (not illustrated) is applied to the second control terminal CT2 in order to turn off the third stage SRC3.

When the fourth clock signal CK4 applied to the clock terminal CK of the fourth stage SRC4 is transitioned to a high state, the fourth carry signal CR4 output from the carry terminal CR of the fourth stage SRC4 is transitioned to a high state. When the fourth clock signal CK4 is transitioned to a low state, the fourth carry signal CR4 is transitioned to a low state.

When the fourth carry signal CR4 is transitioned to the low state, the sixth carry signal CR6 output from the sixth stage SRC6 is applied to the first control terminal CT 1 in order to turn off the fourth stage SRC4. In addition, when the sixth carry signal CR6 is transitioned to a low state, the eighth carry signal SRC8 output from the eighth stage SRC8 (not illustrated) is applied to the second control terminal CT2 in order to turn off the fourth stage SRC4.

The first clock signal CK1 is applied again to the fifth stage SRC5 and a carry signal may be output as described above.

An (m−1)-th carry signal CR(m−1) output from the carry terminal CR of the (m−1)-th stage SRCm−1 is transitioned to a high state at a first time t1. When the (m−1)-th carry signal CR(m−1) is transitioned to the high state, the third clock signal CK3 transitioned to a high state is applied to the clock terminal CK of the (m−1)-th stage SRCm−1.

An m-th carry signal CR(m) output from the carry signal SR of the m-th stage SRCm is transitioned to a high state at a second time t2. When the m-th carry signal CR(m) is transitioned to a high state, the fourth clock signal CK4 transitioned to a high state is applied to the clock terminal CK of the m-th stage SRCm.

An (m−1)-th carry signal CR(m−1) output from the carry signal CR of the (m−1) stage SRCm−1 is transitioned to a low state at a third time t3. When the (m−1)-th carry signal CR(m−1) is transitioned to the low state, the first dummy signal DUMMY transitioned to a high state is applied to the first and second control terminals CT1 and CT2 in order to turn off the (m−1)-th stage SRCm−1. The first dummy signal DUMMY1 in the high stage is also applied to the first control terminal CT1 of the (m−3)-th stage SRCm−3.

An m-th carry signal CR(m) output from the carry signal CR of the m-th stage SRCm is transitioned to a low state at a fourth time t4. When the m-th carry signal CR(m) is transitioned to the low state, the second dummy signal DUMMY2 transitioned to a high state is applied to the first and second control terminals CT1 and CT2 in order to turn off the m-th stage SRCm. The second dummy signal DUMMY2 in the high stage is also applied to the first control terminal CT1 of the (m−2)-th stage SRCm−2.

The first dummy signal DUMMY 1 is transitioned to a low state at a fifth time t5. In addition, the second dummy signal DUMMY 2 is transitioned to a low state at a sixth time t6.

Since the gate driving circuits 410 and 420 according to an exemplary embodiment of the inventive concept do not include a dummy stage, a carry signal is externally applied to the second control terminals CT2 of the (m−3)-th and (m−2)-th stages and the first and second control terminals CT1 and CT2 of the (m−1)-th and m-th stages. Therefore, the first and second dummy signals DUMMY1 and DUMMY2 are applied externally.

Figure 6:
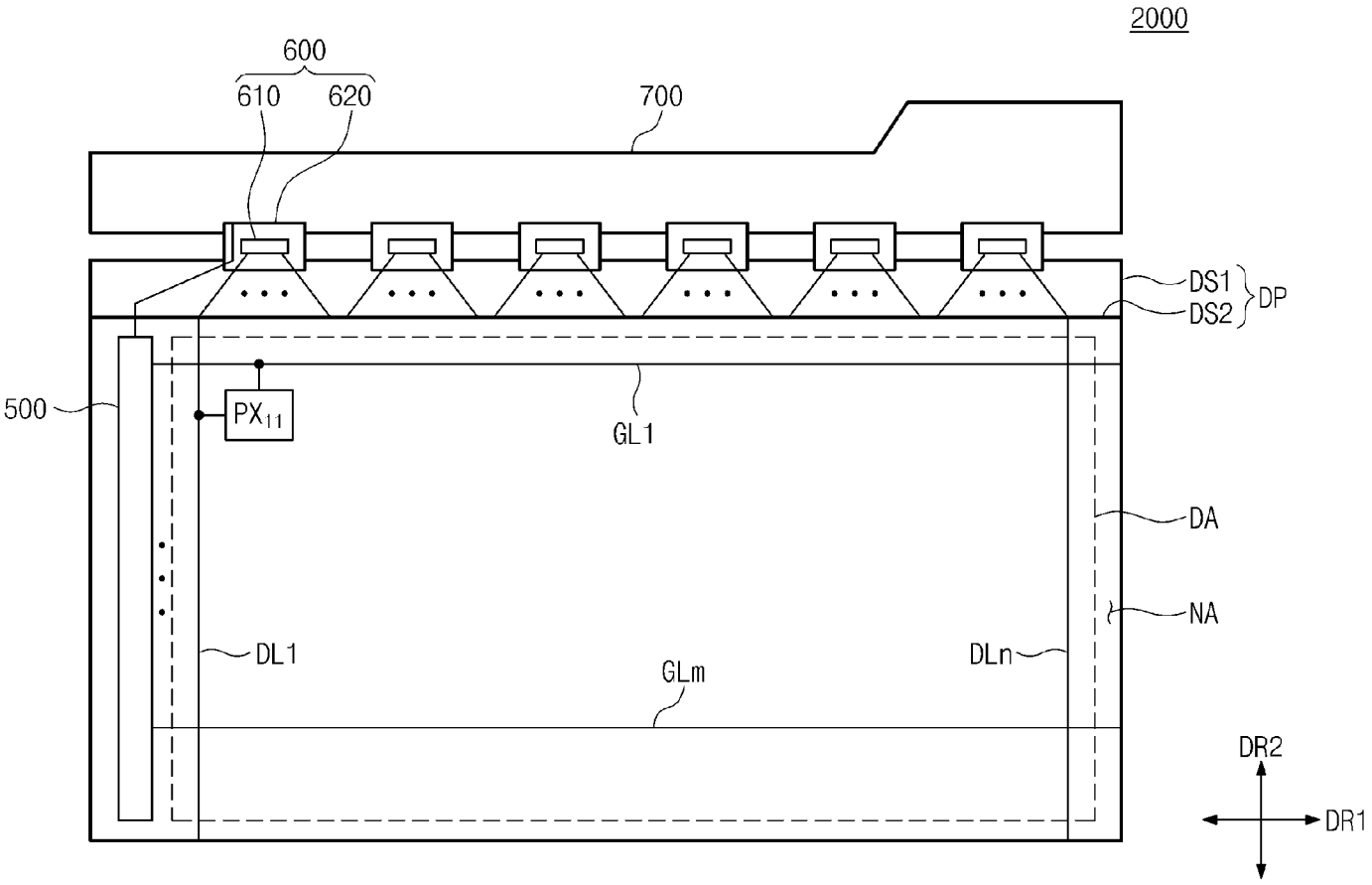
FIG. 6 is a plan view of a display device according to another exemplary embodiment.

FIG. 6 is a plan view of a display device according to another exemplary embodiment of the inventive concept. Referring to FIGS. 4 to 6, a display device 200 includes a liquid crystal display panel DP and a gate driving circuit 500 outputting a gate signal to the liquid crystal display panel DP.

The liquid crystal panel DP includes a lower substrate DS1, an upper substrate DS2 opposite to the lower substrate DS1, and a liquid crystal layer (not illustrated) disposed between the lower and upper substrates DS1 and DS2.

A plurality of pixel areas are defined on the display area DA by a plurality of gate lines GL1 to GLm and a plurality of data lines DL1 to DLn insulated from and intersecting with the plurality of gate lines GL1 to GLm. A pixel PX11 is prepared in each pixel area. The gate driving circuit 500 is located on the outside in a first direction DR1. The gate driving circuit 500 sequentially applies a gate signal to the plurality of gate lines GL1 to GLm.

The gate driving circuit 500 may include the plurality of stages SRC1 to SRCm illustrated in FIG. 4. Since the plurality of stages SRC1 to SRCm do not include a dummy stage, an area thereof may be reduced. For example, the gate driving circuit 500 may be located on both peripheral areas in the first direction.

A plurality of flexible PCBs 600 are attached to the plurality of data lines DL1 to DLn. Each of the plurality of flexible PCBs 600 includes a base film 620 and an integrated circuit chip 610 mounted on the base film 620. The integrated circuit chip 610 is electrically connected to the plurality of data lines DL1 to DLn to output a data voltage. In addition, the plurality of integrated chips 610 may apply the dummy signals DUMMY1 and DUMMY 2 to the gate driving circuit 500.

The display device 2000 further includes a PCB 700 for controlling the gate driving circuit 500 and the plurality of integrated circuit chips 610. The PCB 700 outputs a data control signal for controlling to drive the plurality of integrated circuit chips 610 and image data, and outputs a gate control signal for controlling to drive the gate driving circuit 500.

According to a driving circuit and a display device including the same, a bezel width can be reduced in one direction.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A gate driving circuit comprising m stages (where m is an integer of 4 or greater), each of which outputs a gate signal and is sequentially connected in a cascade arrangement, the gate driving circuit comprising:

an (m−1)-th stage configured to externally receive a first dummy signal for a first time period to control a turn-off;

an m-th stage configured to externally receive a second dummy signal for the first time period to control the turn-off;

an (m−2)-th stage configured to receive an m-th carry signal for a second time period from the m-th stage and externally receive the second dummy signal for the second time period to control the turn-off; and an (m−3)-th stage configured to receive an (m−1)-th carry signal for the second time period from the (m−1)-th stage and externally receive the first dummy signal for the first time period to control the turn-off, wherein the first time period is longer than the second time period.

2. The gate driving circuit of claim 1, wherein the (m−3)-th stage is configured to receive the first dummy signal for the first time period right after receiving the (m−1)-th carry signal for the second time period.

3. The gate driving circuit of claim 1, wherein the (m−2)-th stage is configured to receive the second dummy signal for the first time period right after receiving the m-th carry signal for the second time period.

4. The gate driving circuit of claim 1, wherein the second time period is twice as long as the first time period.

5. The gate driving circuit of claim 1, wherein the m-th carry signal is configured to be applied at a time delayed by a half of the second time of the (m−1)-th carry signal.

6. The gate driving circuit of claim 1, wherein m stages are connected to a plurality of gate lines and configured to output the plurality of gate signals.

7. The gate driving circuit of claim 1, wherein a plurality of clock signals are configured to be sequentially applied to the m stages respectively to output the gate signals.

8. The gate driving circuit of claim 1, wherein the m stages are configured to respectively receive carry signals from preceding stages to determine timing to output the gate signals, and a first stage of the m stages is configured to receive a vertical start signal.

9. A display device comprising:

a thin film transistor substrate comprising:

a display area comprising gate lines extended in a first direction and data lines insulated from gate lines and extended in a second direction intersecting with the first direction; and a non-display area peripheral the display area;

a gate driving circuit disposed in the non-display area and comprising m stages (where m is an integer of 4 or greater) configured to provide a gate signal to the gate lines, wherein the gate driving circuit comprises, an (m−1)-th stage configured to externally receive a first dummy signal for a first time period to control a turn-off;

an m-th stage configured to externally receive a second dummy signal for the first time period to control the turn-off;

an (m−2)-th stage configured to receive an m-th carry signal for a second time period from the m-th stage and externally receive the second dummy signal for the first time period to control the turn-off; and an (m−3)-th stage configured to receive an (m−1)-th carry signal for the second time period from an (m−1)-th stage and externally receive the first dummy signal for the first time period to control the turn-off, wherein the first time period is longer than the second time period.

10. The display device of claim 9, wherein the gate driving circuit comprises a first gate driving circuit and a second driving circuit separated from each other, and each of the first and second driving circuits comprises the m stages.

11. The display device of claim 10, wherein:

the first gate driving circuit comprises first connection lines configured to connect to the gate lines; and the second gate driving circuit comprises second connection lines configured to connect to the gate lines.

12. The display device of claim 9, wherein the gate driving circuit is disposed in a first non-display area arranged peripheral to the display area in the second direction.

13. The display device of claim 9, wherein the gate driving circuit is disposed in a second non-display area arranged peripheral to the display area in the first direction.

14. The display device of claim 9, wherein the second time period is twice as long as the first time period.

15. The display device of claim 9, further comprising:

a printed circuit board configured to drive the thin film transistor substrate; and a flexible printed circuit board configured to electrically connect the thin film transistor substrate and the printed circuit board, wherein the flexible printed circuit board comprises a base film and an integrated circuit chip formed on the base film.

16. The display device of claim 15, wherein the integrated circuit chip is configured to apply the first and second dummy signals.

* * * * *